US006142842A

United States Patent [19]

Watanabe et al.

[11] Patent Number: 6,142,842

[45] Date of Patent: Nov. 7, 2000

[54] MANIFOLD ARRANGEMENT FOR OUTBOARD MOTOR

[75] Inventors: Hitoshi Watanabe; Noriyoshi Hirakoa; Masanori Takahashi, all of Hamamatsu, Japan

[73] Assignee: Sanshin Kogyo Kabushiki Kaisha, Japan

[21] Appl. No.: 09/141,482

[22] Filed: Aug. 27, 1998

[30] Foreign Application Priority Data

Sep. 12, 1997 [JP] Japan ..... 9-268117

[51] Int. Cl.[7] ..... B63H 21/38

[52] U.S. Cl. ..... 440/88; 123/184.21; 123/184.46

[58] Field of Search ..... 440/88; 123/184.21, 123/184.42, 184.35, 184.47, 184.46, 184.61

[56] References Cited

U.S. PATENT DOCUMENTS

| | | | |
|---|---|---|---|
| 3,114,669 | 12/1963 | Herbst | 123/184.21 |
| 5,012,770 | 5/1991 | Okamoto et al. | 123/184.42 |
| 5,544,629 | 8/1996 | Ohata et al. | 123/184.36 |
| 5,832,890 | 11/1998 | Ikeya et al. | 123/184.47 |
| 5,833,504 | 11/1998 | Ikeya et al. | 440/88 |
| 5,870,987 | 2/1999 | Ikeya et al. | 123/184.24 |
| 5,873,755 | 2/1999 | Takahashi et al. | 440/77 |
| 5,899,197 | 5/1999 | Watanabe et al. | 123/184.42 |

*Primary Examiner*—Sherman Basinger
*Attorney, Agent, or Firm*—Knobbe, Martens, Olson & Bear, LLP

[57] ABSTRACT

An outboard motor having a multi-cylinder four-cycle, internal combustion engine as a power plant. An improved crankcase ventilating system is provided wherein the camshaft chambers and then to the intake system through an extended conduit passing over the exhaust manifold so as to reduce the emissions of hydrocarbons. The intake system is designed to preclude uneven distribution of the ventilating gasses. The intake system also is comprised of a plenum device, a plurality of runners and throttle bodies and an intake manifold that are attached as a unit to the rest of the engine body. Locating pins assist in this attachment.

23 Claims, 9 Drawing Sheets

MANIFOLD ARRANGEMENT FOR OUTBOARD MOTOR

BACKGROUND OF THE INVENTION

This invention relates to an intake manifold for an outboard motor and more particularly to an improved, lightweight and easily assembled intake manifold for such applications.

There has been an increasing emphasis toward the use of four cycle engines in outboard motors because of their more environmentally friendly nature. However, when replacing more conventionally employed two cycle engines, certain design challenges are presented. This is primarily due to the more complicated configuration of the engine, particularly when high specific outputs are sought.

The induction system for a four cycle engine is considerably different from that for a two cycle engine and hence, the induction system for four cycle outboard motors presents some unique problems. This is particularly true in conjunction with multi-cylinder engines and because of the fact that the engine is mounted so that the cylinder bores extend horizontally rather than vertically.

In connection with the induction system, it is generally the practice to employ a plenum chamber into which atmospheric air is drawn from within the protective cowling of the outboard motor. This plenum chamber then communicates with a plurality of throttle bodies and the cylinder head intake passages through manifolds, runners and intake manifolds. Thus, a fairly bulky and cumbersome arrangement result.

Also, it has been found that the length of the intake system between the plenum chambers and the cylinder head intake passages should be fairly large in order to provide the desired performance characteristics. This further complicates the design and mounting of the various components.

It is, therefore, a principle object of this invention to provide an improved, lightweight intake manifold for an internal combustion engine. It is a further object of this invention to provide an improved intake manifold for a four cycle outboard motor and particularly one having multiple cylinders.

It is a further object of this invention to provide an improved, simplified and easily assembled intake manifold for a four cycle outboard motor.

If the induction system is to be connected as a unit to the remainder of the engine, spatial problems may arise. This is particularly true if the assembly is done when the engine body is already mounted in the power head. Also these problems also exist when servicing completed outboard motors.

That is, it is important that the fit between the induction system and the remaining engine body be accurate. This is particularly true in matching the flow passages. Usually this alignment is accomplished by positioning studs in the engine body and particularly the cylinder head. These studs have non-threaded portions which serve the function of locating the intake manifold upon its attachment to the cylinder head. As will be described later by particular reference to FIG. 11, however, at times this is not possible, particularly when the engine body is already mounted in the protective cowling. This type of positioning arrangement requires a fairly substantial transverse clearance so that the induction system can be fitted not only over the threaded portion of the stud but also the non-threaded portion.

It is, therefore, a principal object of this invention to provide an improved manifold attaching system for the induction system of an outboard motor.

It is a further object of this invention to provide an improved and compact locating arrangement for such applications that minimize the spatial requirements required to assemble and disassemble the induction system from the engine body.

SUMMARY OF THE INVENTION

This invention is adapted to be embodied in an internal combustion engine having a cylinder block with a plurality of vertically spaced cylinder bores. A cylinder head is affixed to one end of the cylinder block so as to close one end of the cylinder bores. A crankcase member is affixed to the other end of the cylinder block so as to close the other end of the cylinder bores and to form a crankcase chamber in which a crankshaft is rotatably journaled. Pistons are slidably supported in each of the cylinder bores and are connected to the crankshafts to drive it. The pistons, cylinder bores and cylinder head form the combustion chambers of the engine. An induction system is provided for delivering at least an air charge to the engine combustion chambers. This induction system includes a vertically extending, elongated plenum chamber that is juxtaposed to the crankcase member and which has an air inlet opening formed in a side thereof. A plurality of runner sections extend from the plenum chamber to a manifold that attaches to individual intake ports of the engine. This induction system is connected as a unit and then is attached to the remaining engine body by means that include locating pins fixed to the engine body.

DETAILED DESCRIPTION OF THE PREFERRED EMBODIMENT OF THE INVENTION

Figure 1:
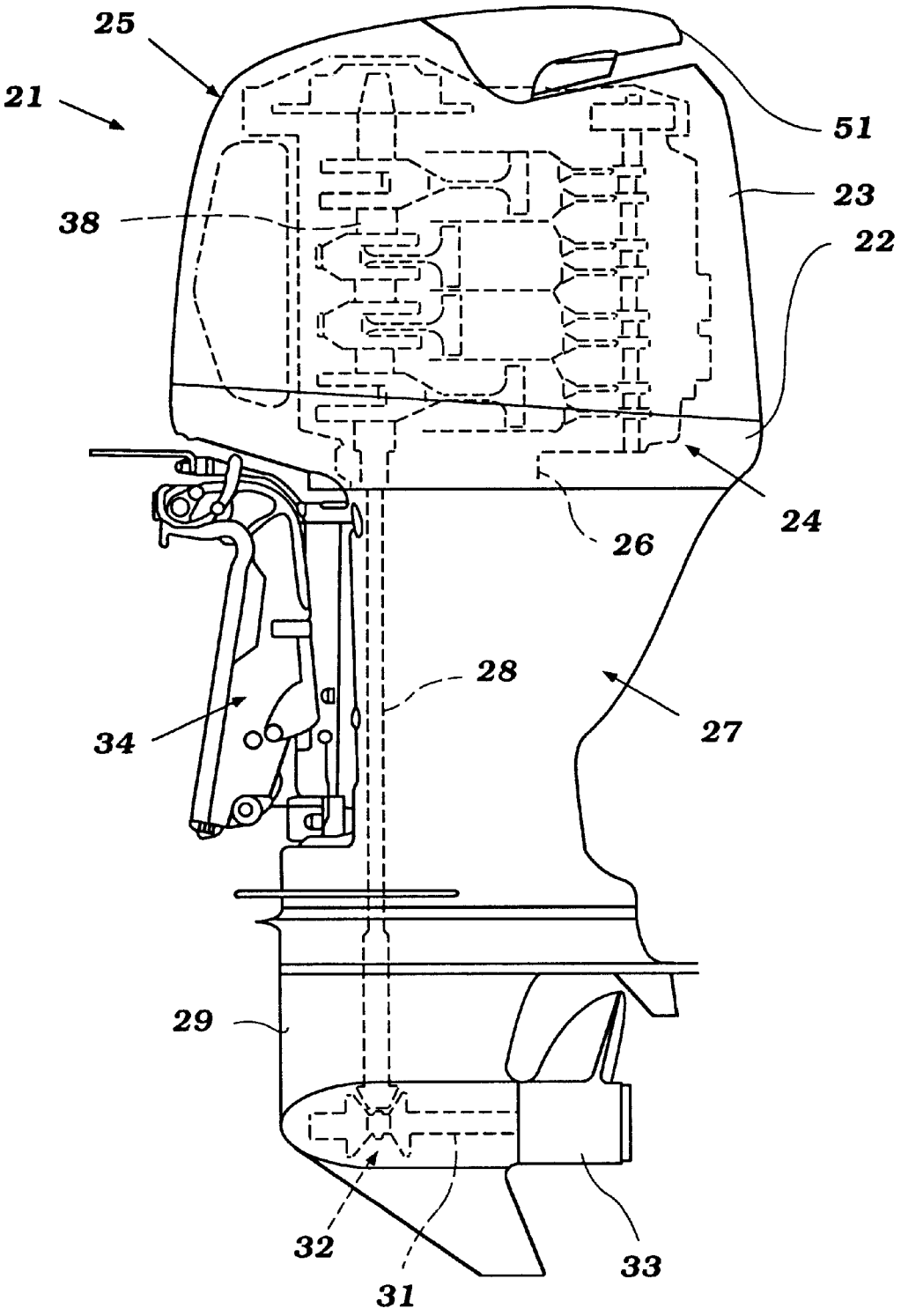
FIG. 1 is a side elevational view of an outboard motor constructed in accordance with an embodiment of the invention and illustrated in an orientation it would have if attached to the transom of an associated watercraft.

Referring now in detail to the drawings and initially to FIG. 1, this Figure illustrates an outboard motor, indicated generally by the reference numeral 21 in an orientation in which it would appear if attached to the transom of an associated watercraft. The outboard motor 21 includes a power head comprised of a lower tray portion 22 and a detachably connected, upper, main cowling portion 23. This cowling assembly surrounds an engine, identified generally by the reference numeral 24. Although the invention is described in connection with the outboard motor 21, it will be understood by those skilled in the art that the invention is capable of use with other applications than outboard motors. However, the invention has particular utility in conjunction with outboard motors due to the fact that they are designed so that their crankshaft rotates about the vertically extending axis for a reason which will become apparent shortly. The engine 24 forms a part of the power head of the outboard motor 21 and this power head is identified generally by the reference numeral 25.

The engine 24 is mounted on an exhaust guide plate 26 that is positioned at the upper end of a drive shaft housing and lower unit, indicated generally by the reference numeral 27. A driveshaft 28 is journaled in this drive shaft housing and lower unit 27 for rotation about a vertically extending axis. It is because of this orientation of the axis of drive shaft 28 that the engine 24 is mounted so that its crankshaft rotates about a vertically extending axis. This is done so as to facilitate a direct connection between the engine crankshaft and the drive shaft 28.

The drive shaft 28 depends into a lower unit portion 29 of the drive shaft housing and lower unit 27. There, it drives a propeller shaft 31 selectively through a forward, neutral, reverse transmission 32. This type of transmission is well known in the art. A propeller 33 is affixed for rotation with the propeller shaft 31 so as to create a propulsion for the associated watercraft.

The outboard motor 21 is completed by a combined swivel bracket and clamping bracket assembly, indicated generally by the reference numeral 34 by which the outboard motor is attached to the transom of an associated watercraft in the orientation as seen in FIG. 1 for steering movement about a vertically extending axis and for tilt and trim movement about a horizontally extending axis.

The aforenoted description of the outboard motor is, as noted, so as to permit those skilled in the art to understand an environment in which the invention may be employed. Obviously, those skilled in the art will understand how to apply the invention's principles to any type of outboard motor structure or, as noted above, any arrangement where a four-cycle engine is positioned so that its crankshaft rotates about a vertically extending axis.

The construction of the engine 24 will now be described, initially by reference primarily to the remaining figures. In the illustrated embodiment, the engine 24 is of the four cylinder, inline type and operates on a four-stroke principle. Although the invention can be employed with engines having other cylinder numbers and other cylinder orientations, the four cylinder construction described will provide adequate information so as to permit those skilled in the art to be able to practice the invention with such other arrangements.

The engine 24 is comprised of a cylinder block 35 in which four horizontally extending, vertically spaced, cylinder bores 36 are formed. One end of the cylinder bores 36 is closed by a crankcase member 37 which is affixed to the cylinder block 35 in a manner to be described and which defines a crankcase chamber in which the engine crankshaft 38 rotates about a vertically extending axis.

The bearing arrangement for the crankshaft 38 is provided by bearing webs 39 (FIG. 2) that are formed in the cylinder block 35 and cooperating bearing portions 41 formed by the crankcase member 37. The crankcase member 37 is affixed to the cylinder block 36 in the area of these bearings and, if desired, at other locations by threaded fasteners 42.

Figure 2:
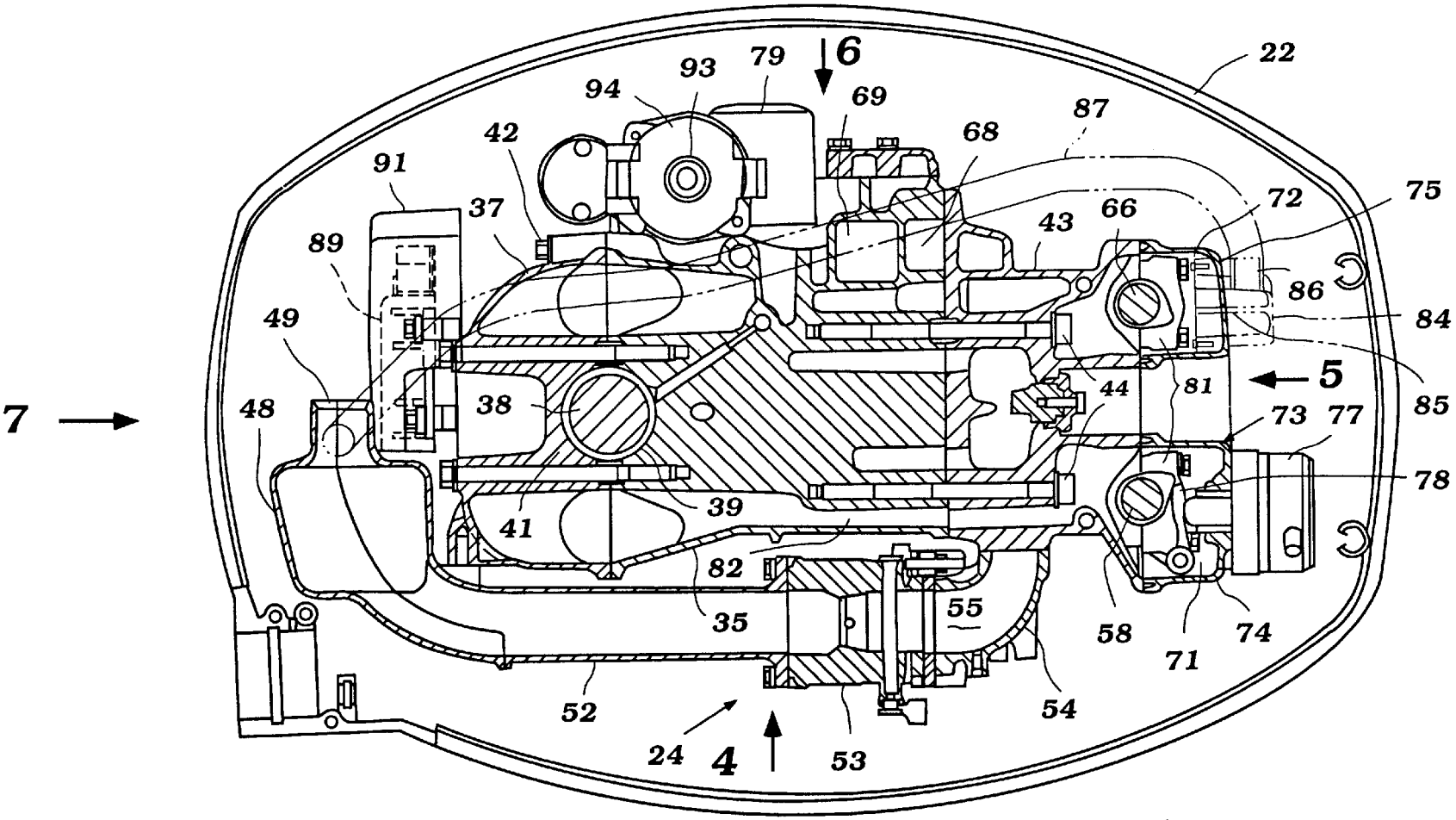
FIG. 2 is a top plan view of the outboard motor power head with the main cowling member removed and showing the engine in cross section taken on a horizontal plane passing between two cylinders to show the crankshaft bearing arrangement.

The opposite ends of the cylinder bores 36 are closed by a cylinder head assembly that is comprised primarily of a main cylinder head member 43. This cylinder head member 43 is affixed to the cylinder block 35 by threaded fasteners 44 (FIG. 2).

Pistons 45 are slidably supported in the cylinder bores 36. These pistons 45 are connected to the small ends of connecting rods 46 by piston pins. The big ends of these connecting rods 46 are journaled on the throws of the crankshaft 38 in a manner well known in the art. The cylinder head 43 is formed with recesses 47 that cooperate with the heads of the pistons 45 and the cylinder bores 36 to define the combustion chambers of the engine.

An induction system, positioned primarily on the left hand side of the outboard motor 21, is provided for delivering an air charge to these combustion chambers. This induction system includes an elongated, generally vertically extending air inlet device and silencer mechanism 48 that is disposed adjacent the forward end of the crankcase member 37 and which has a sidewardly directed air inlet opening 49. This inlet opening 49 admits air that has been drawn into the protective cowling member 24 through a rearwardly facing air inlet opening formed in part by a cover member 51 (FIG. 1).

The air from the inlet device 48 passes through a plurality of runner sections 52 to throttle bodies 53. The throttle bodies 53 have throttle valves positioned in them that are controlled by the operator through a suitable linkage or cable system.

Air passing through the throttle bodies 53 is delivered to an intake manifold 54 that has runner sections 55, each of which cooperates with one or more intake passages 56 formed in the cylinder head assembly and specifically the main cylinder head member 43. These intake passages terminate at intake valve seats formed in the cylinder head recesses 47. An intake valve arrangement 57 is mounted in the cylinder head assembly and specifically the main cylinder head member 43 for controlling the flow through these intake valve seats.

These intake valves 57 are actuated by the lobes of an intake camshaft 58 that is rotatably journaled in the cylinder head member 43 in a manner that will be described. This intake camshaft 58 is driven by a timing belt 59 (FIGS. 4–7) that engages a drive sprocket 61 fixed to an upper end of the cam shaft 58. The timing belt 59 is driven by a timing pulley (not shown) that is connected to the crankshaft. The size of the pulleys is such that the intake cam shaft 58 is driven at one-half crankshaft speed.

Figure 8:
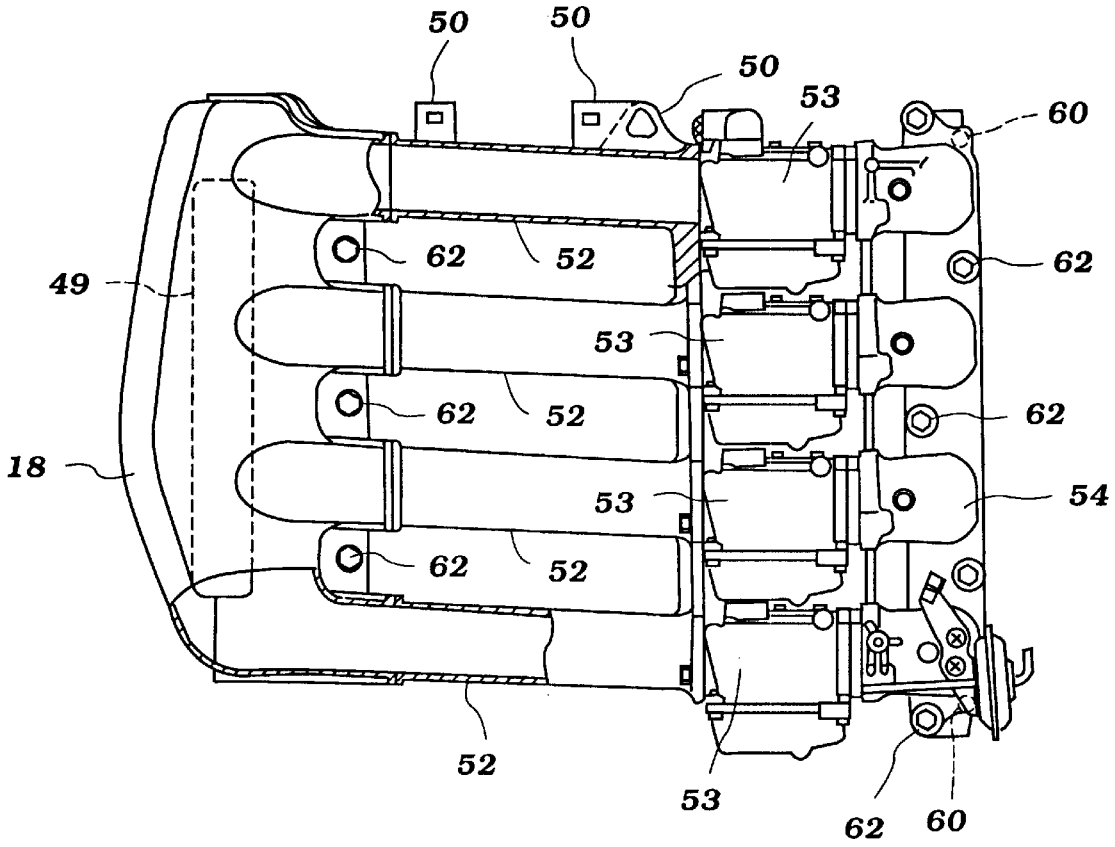
FIG. 8 is a view looking in the same direction as FIG. 4 but showing only the engine induction system.
Figure 9:
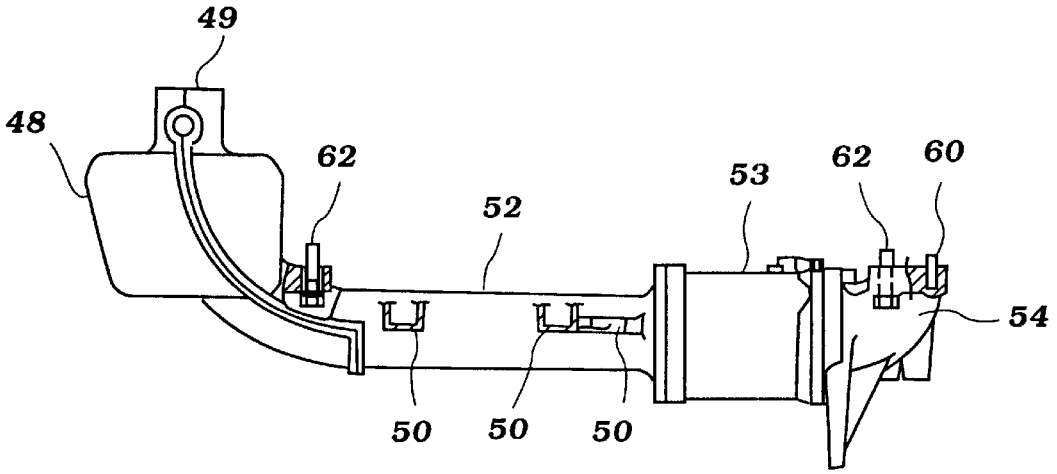
FIG. 9 is a top plan view of the portion of the engine induction system shown in FIG. 8.

As best seen in FIGS. 8 and 9, the intake manifold 54 and the intake device 48 have flange portions through which threaded fasteners 62 extend so as to affix the induction system to the left hand side of the engine. As also seen in this figure, the lowermost intake pipe 52 extends so that it blends into the bottom wall of the intake device 48 so that there is no void area at the bottom of the intake device 48 where liquids could collect. Thus it is not necessary to include any drain hole in this area to drain condensed liquids. Also, as clearly seen in FIGS. 4 and 8, the intake pipes 52 all have a slight downhill run from their inlet ends to their discharged ends at the throttle bodies 53.

The entire induction system comprised of the plenum chamber 48, the runners 52, the throttle bodies 53 and the intake manifold 54 may be assembled as a unit before attachment to the remainder of the engine 24. To assist in this, keep the weight relatively low and maintain the desired center of gravity, the plenum chamber 48 and runner sections 52 may be formed from a synthetic resin. Further hangers 50 may be formed on the uppermost runner 52 in proximity to the upper area of the center of gravity to accept other fasteners for attachment to the cylinder block 35.

Locating pins 60 are provided between the intake manifold 54 and the cylinder head 43 so as to assist in the accurate positioning of the intake system to the cylinder head member 43 with the passages in good registry therewith. After this location is completed, the fasteners 62 may be installed or tightened.

Figure 10:
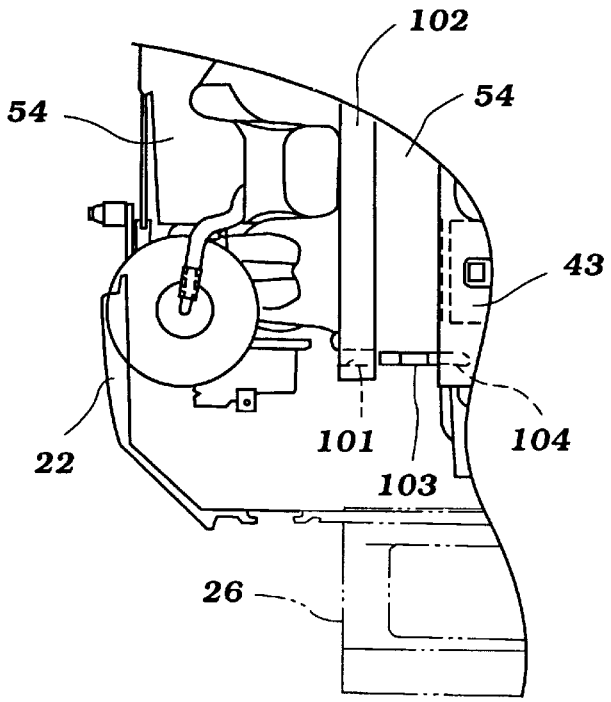
Figure 10 Prior Art
FIG. 10 is a view looking in a direction equivalent the direction of the arrow 10 in FIG. 9 but showing how the prior art type of arrangements are located.

The advantages of the use of the locating pins 60 as opposed to the previous type stud fastening and locating arrangement may be best understood by reference to FIG. 10 that shows the prior art type of construction normally employed. It will be seen in this figure, that the normal and prior art type of arrangement would employ the formation of bored openings 101 in a flange 102 of the intake manifold 54. These locating bores 101 are designed so as to cooperate with non-threaded portions 103 of attaching studs 104 by which the intake manifold 54 is conventionally affixed to the cylinder head member 43.

Figure 11:
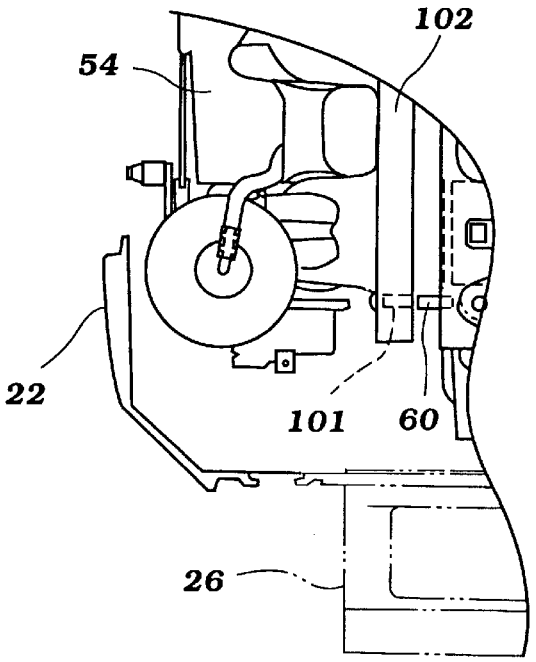
FIG. 11 is a view, in part similar to FIG. 10, but showing how the construction of this embodiment eliminates the problems attendant with the prior art.

As may be seen in this figure, this arrangement does not permit assembly or disassembly of the induction system when mounted in the power head and when the tray portion 22 is in place. However, as seen in FIG. 11, by not employing stud type fasteners and the machine portions for location purposes, it is possible to use short locating pins 60 that cooperate with bored openings 101 for location purposes. The locating pins 60 can be shorter in axial length than the non-threaded portions 103 of stud and also the threaded portions are eliminated so as to permit the induction system to be slipped into place and installed without removing the tray 22.

Figure 5:
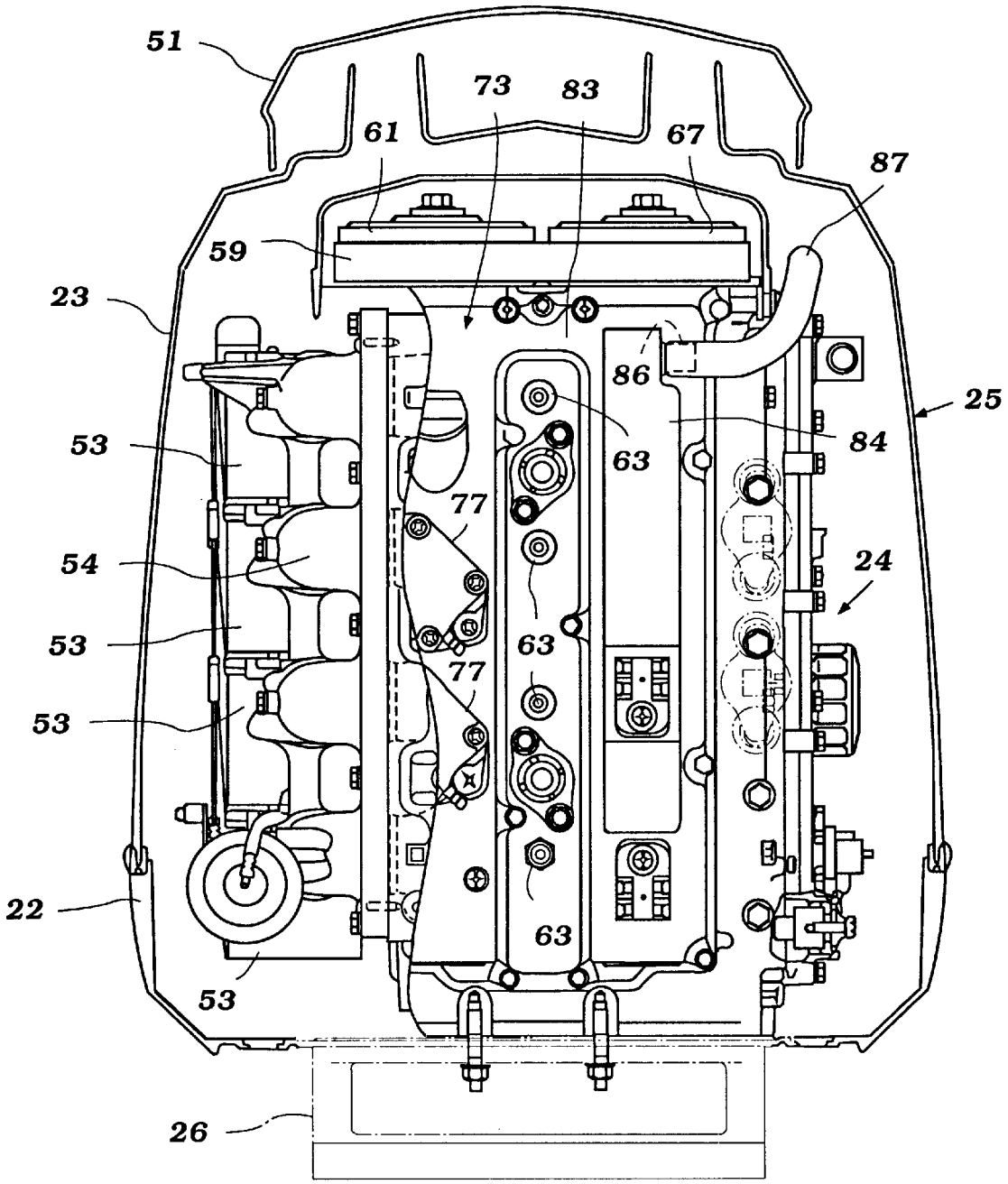
FIG. 5 is a rear elevational view, looking in the direction of the arrow 5 in FIG. 2 and again showing the engine in solid lines and the surrounding protective cowling in phantom.

As seen best in FIG. 5, spark plugs 63 are mounted in the cylinder head assembly and specifically the main cylinder head member 43. These spark plugs 63 have their spark gaps disposed in the recessed areas 47 for firing a fuel air charge which has been formed therein.

This fuel air charge may be formed by utilizing either one or more carburetors, which can be positioned as the throttle body 53 or by means of a fuel injection system. The fuel injection system may include injectors that inject fuel into either the induction system or directly into the cylinder head recesses 47. Since this fuel charging system forms no part of the invention, it has not been illustrated and those skilled in the art will readily understand how the invention can be utilized in conjunction with any wide variety of types of charge formers.

The ignited charge will burn and expand so as to drive the pistons 45 in the cylinder bores 36 and effect rotation of the crankshaft 38 as is well known in the art.

The burned charge is discharged from the combustion chambers through an exhaust system which is generally formed on the opposite side of the engine from the intake system. This includes one or more exhaust passages 64 formed in the cylinder head body 43 and which originate at exhaust valve seats formed in the cylinder head recesses 47. Poppet type exhaust valves 65 valve these exhaust valve seats.

Like the intake valve 57, the exhaust valves 65 are operated by any known type of mechanism which includes the cam lobes of an exhaust camshaft 66 that is journaled in the cylinder head member 43 for rotation about an axis that is parallel to the axis of rotation of the intake camshaft 58 and the crankshaft 38. This journal arrangement will also be described in more detail later. A driven sprocket 67 is affixed to the upper end of the exhaust camshaft 66 and is also driven by the drive belt 59 at one-half crankshaft speed.

The cylinder head exhaust passages 64 have a reentrant curvature and communicate with exhaust manifold runner sections 68 formed in a facing surface of the cylinder block 35. These exhaust manifold runners 68 communicate with a collector section 69 which extends vertically downwardly and which cooperates with an exhaust system through an opening formed in the exhaust guide plate 26.

This exhaust system may have any known type of silencing mechanism and generally consists of a high-speed, underwater exhaust discharge and an idle above the water exhaust discharge. Since these systems are well known, further description of them is not believed to be necessary to permit those skilled in the art to practice the invention.

Figure 3:
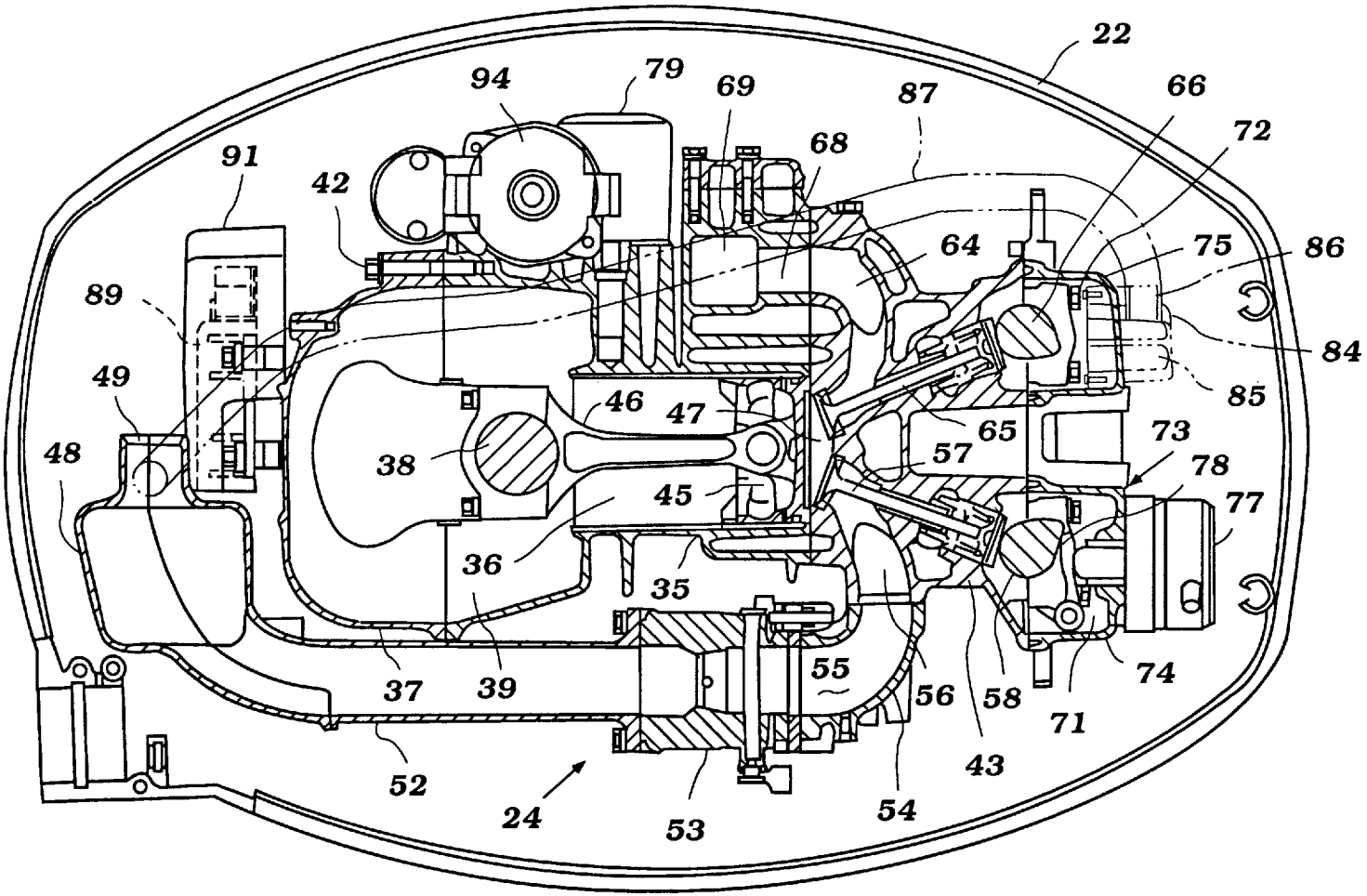
FIG. 3 is a top plan view of the outboard motor power head, in part similar to FIG. 2 but showing the engine in cross section taken on a horizontal plane passing through the axis of one of the cylinders.
Figure 4:
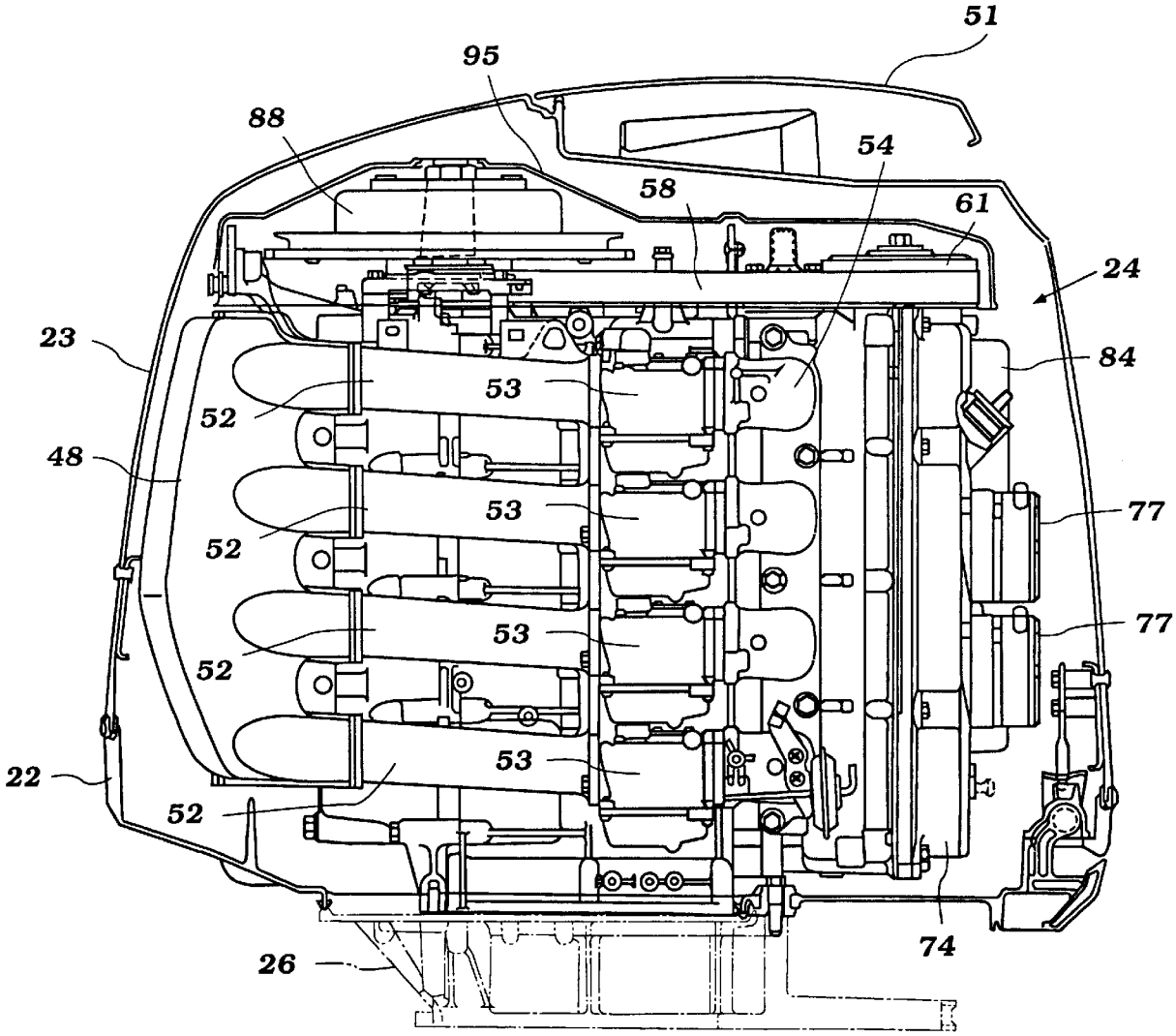
FIG. 4 is a left side elevational view, looking in the direction of the arrow 4 in FIG. 2 and showing primarily the power head with the protective cowling removed and with the part of the engine broken away and shown in section.

As seen in FIG. 3, the cylinder head member 43 forms a pair of cavities in its rearward surface indicated by the reference numerals 71 and 72 which may be considered to be intake and exhaust cam chambers. These cam chambers are closed by a single cam cover 73 that has portions 74 and 75 that overlie and close the recesses 71 and 72. A sealing gasket 76 is provided in the peripheral edge of the cam cover 73 to effect a tight oil seal between it and the cylinder head member 43.

Although the charge-forming system for the engine may be of any type, as seen best in FIGS. 2–5, a pair of fuel pumps 77 are mounted on the intake side 74 of the cam cover 73. These are operated from cam lobes on the intake camshaft 58 via finger followers 78 (FIGS. 2 and 3) so as to effect their pumping operation.

A lubricating system of any suitable type is provided for the engine 24. This lubricating system preferably is comprised of an oil reservoir (not shown) which is mounted on the underside of the exhaust guide plate 26 and which depends into the drive shaft housing and lower unit 27 and more particularly to the upper portion of the drive shaft housing part thereof. Oil is drawn from this reservoir by a suitably driven pump and circulated through the various bearing surfaces after passing through a cartridge type oil filter 79 that is mounted on the exhaust side of the engine. The bearing surfaces lubricated include those for the intake and exhaust cam shafts 58 and 66.

The intake and exhaust cam shafts 58 and 66 are journalled in the cam chambers 71 and 72 respectively by bearing surfaces formed in the cylinder head member 43. Bearing caps 81 are fixed at locations along the length of the respective cam shaft 58 and 66 and cooperate with these cylinder head bearing surfaces.

Except for the crankcase ventilation system, the engine lubricating system forms no part of the invention. Therefore further description of it is not necessary for those skilled in the art to practice the invention. The oil is also returned to the aforenoted but not illustrated oil tank through a suitable drain arrangement.

The system for ventilating the crankcase chamber and the cam chambers 71 and 72, will now be described first by reference to FIGS. 1 and 2. Blowby gases that escape past the pistons 45 flow into the crankcase chamber. These gasses then flow toward the intake camshaft chamber 71 through a plurality of passages 82 that are formed in the cylinder block 35 on the intake side of the engine.

Figure 6:
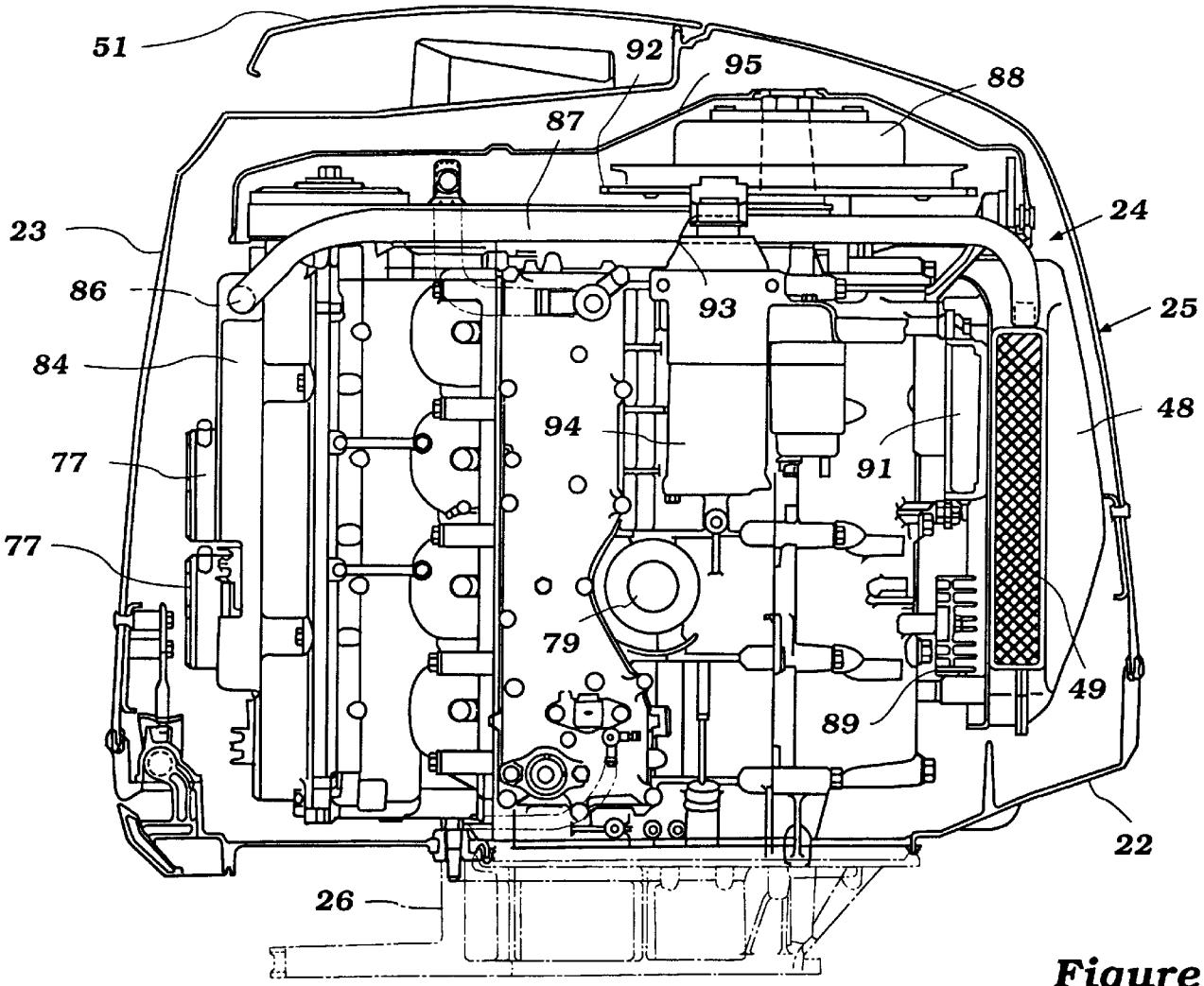
FIG. 6 is a right side elevational view of the power head looking generally in the direction of the arrow 6 in FIG. 2.
Figure 7:
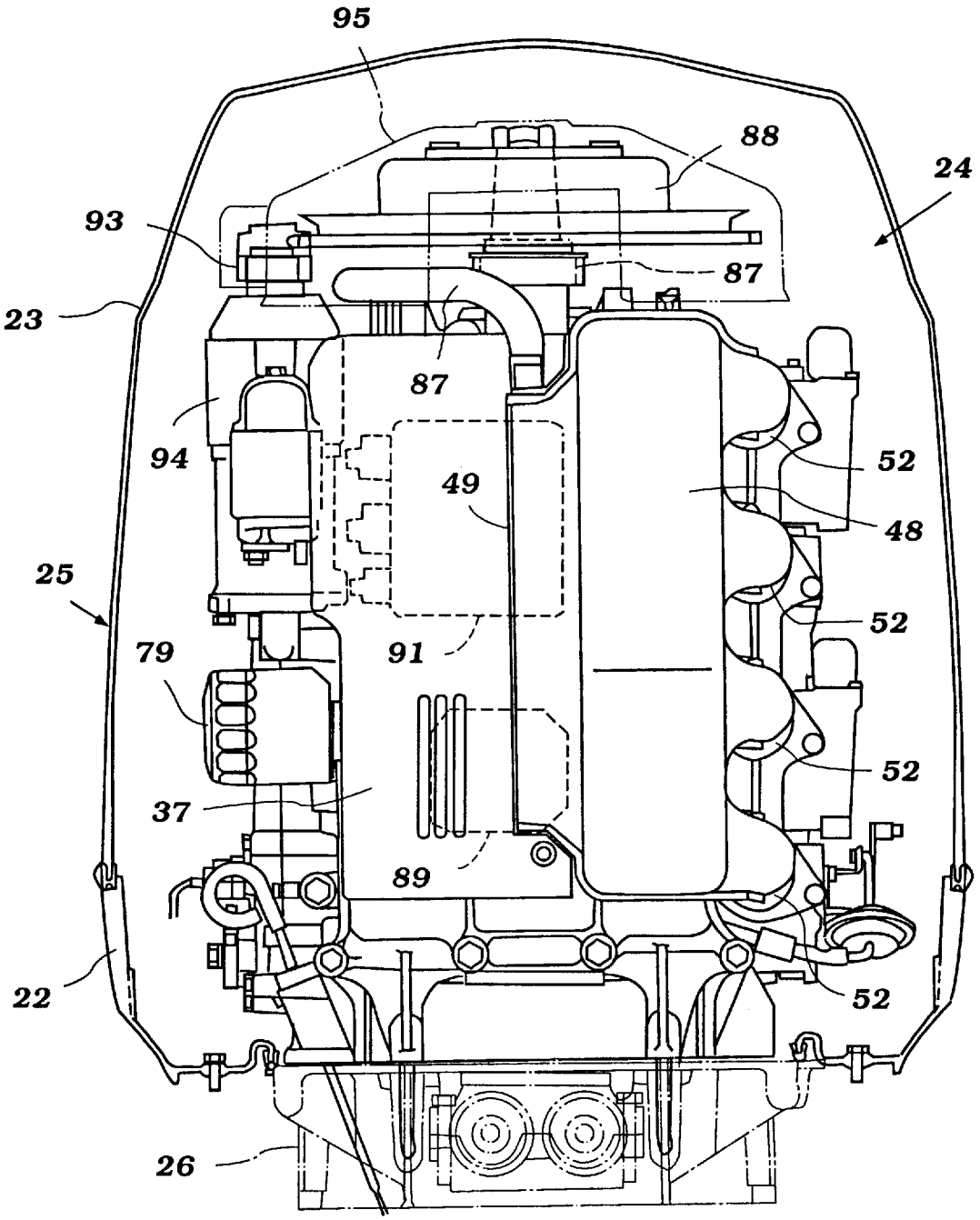
FIG. 7 is a front-elevational view of the power head looking generally in the direction of the arrow 6 in FIG. 2.

These passages 82 are basically formed between adjacent cylinders on opposite sides of the bearing webs 39 as also seen in FIG. 6. These gases then enter the intake camshaft chamber 71. While flowing through the cylinder block passages 82, any entrained oil will tend to precipitate out and drain back to the oil reservoir through the oil return path.

Once in the intake camshaft chamber 71, these crankcase ventilation gases may then flow across to the exhaust camshaft chamber 72. This flow can occur both through a restricted passageway (not shown) at the lower end of the cylinder head 43 and also through a larger, somewhat less restricted passageway formed at the upper end of the cylinder head member 46 by a bridging portion 83 (FIG. 5) of the cam cover 73.

When these gases then enter the exhaust camshaft chamber 71, they may be discharged through a separator arrangement, indicated by the reference numeral 84 best shown in FIGS. 2 and 3. This separator 84 is formed integrally in the cam cover 73. This includes a downwardly extending baffle 85 that separates the interior of the separator 84 into a pair of sections. One of the sections is in communication with the chamber 72 through a ventilating inlet opening at the upper end of the separator 84.

Thus, the ventilating gases must flow downwardly along the wall 84 and then back upwardly to a ventilating gas discharge nipple 86 formed in the exterior of the cam cover 73 exhaust side 75. A flexible conduit 87 interconnects this discharge nipple 86 with the induction system inlet section 49.

It will be seen that the flexible conduit 87 extends from one end of the power head, i.e., the rear end, forwardly and partially across the engine to the intake device air inlet portion 49. This brings the conduit 87 across the upper end of the exhaust manifold and specifically its uppermost runner section 68 and the upper end of the collector section 69. This will cause some heat generation that should vaporize any water that remains after the air has flown through this circuitous path as well as any oil that may still remain in the blowby gases.

Because of the upper introduction of the ventilating gasses to the plenum chamber inlet 49, the crankcase gasses will be distributed equally to all cylinders and mixed well with the fresh intake air. The downhill slant of the runners 52 will also insure that any condensed liquids will be passed into the cylinders for combustion therein.

It has been noted that the timing belt 59 is driven by a timing pulley that is affixed to the upper end of the crankshaft 58. This timing pulley does not appear in the drawing but it is positioned immediately below a flywheel magneto assembly 88 that is affixed to the upper end of the crankshaft 38. This flywheel magneto 88 has a charging system which is employed for providing a charge for firing the spark plugs 63.

The output from the magneto generator charging coil is transmitted to a voltage regulator rectifier device 89 that is mounted at a cool place on the engine and specifically on the forward facing surface of the crankcase member 37 and in an area in proximity to the intake device air inlet 49 so as to be cooled. This rectifier regulator 89 supplies electrical power to a control device 91 which is mounted above it and also on the crankcase member 37 in proximity to the air inlet device 49 for cooling purposes. This control device 91 transmits a signal to the ignition system for the engine for firing the spark plugs 63 in a well known manner.

The flywheel magneto 88 is also provided with a ring gear 92 that is adapted to be engaged by a pinion gear 93 affixed to the shaft of a starter motor 94. The starter motor 94 is mounted on the exhaust side of the engine and is employed for starting the engine 24 in a well known manner.

A cover plate 95 overlies the timing drive mechanism to protect it from direct contact with atmospheric elements and particularly any water vapor that may be contained within the inducted air.

Thus, it is believed that apparent from the foregoing description, that the described construction provides a very compact, light weight and easily assembled and attached induction system for a four cycle, multi-cylinder outboard motor. It should be apparent, however, that the foregoing description is that of the preferred embodiment of the invention and that various changes and modifications may be made without departing from the spirit and scope of the invention, as defined by the appended claims.

What is claimed is:

1. An internal combustion engine having a cylinder block with a plurality of vertically spaced cylinder bores, a cylinder head affixed to one end of said cylinder block so as to close one end of said cylinder bores, a crankcase member is affixed to the other end of said cylinder block so as to close the other end of said cylinder bores and to form a crankcase chamber in which a crankshaft is rotatably journaled, pistons slidably supported in each of said cylinder bores and connected to said crankshaft to drive the crankshaft, said pistons, said cylinder bores and said cylinder head forming combustion chambers of said engine, and an induction system for delivering at least an air charge to said engine combustion chambers, said induction system includes a vertically extending, elongated plenum chamber that is juxtaposed to said crankcase member and which has an air inlet opening formed in a side thereof, a plurality of runner sections extending from said plenum chamber to individual intake ports of said engine, said runner sections all extending along one side of said engine, said induction system comprised of at least said plenum chamber, said runner sections and a manifold that attaches to said individual intake ports of said engine connected as a unit and attached to the remaining engine body with the use of locating pins fixed to the engine body, said locating pins not extending through said manifold.

2. An internal combustion engine as set forth in claim 1 wherein the induction system further includes a plurality of throttle bodies each containing a throttle valve each of which is associated with a respective one of the runner sections and forming a further part of the assembled unit.

3. An internal combustion engine as set forth in claim 2, wherein the throttle bodies are interposed between said runner sections and the intake manifold.

4. An internal combustion engine as set forth in claim 3 wherein the plenum chamber and the runner sections are formed from a synthetic resin.

5. An outboard motor including an internal combustion engine as set forth in claim 1, said outboard motor being comprised of a power head consisting of said engine and a surrounding protective cowling including a tray portion, a drive shaft housing and lower unit depending from said power head and containing a propulsion device for an associated watercraft and a transmission for driving said propulsion device from said engine, said engine being mounted in said power head on an exhaust guide so that the crankshaft rotates about a vertically extending axis, at least one of the locating pins being juxtaposed to said tray portion.

6. An outboard motor as set forth in claim 5 wherein the induction system further includes a plurality of throttle bodies each containing a throttle valve each of which is associated with a respective one of the runner sections and forming a further part of the assembled unit.

7. An outboard motor as set forth in claim 6, wherein the throttle bodies are interposed between said runner sections and the intake manifold.

8. An outboard motor as set forth in claim 7 wherein the plenum chamber and the runner sections are formed from a synthetic resin.

9. An outboard motor as set forth in claim 5 wherein said at least one locating pin, which is fixed to the engine body, is positioned lower than the upper edge of the tray.

10. An internal combustion engine having a cylinder block with a plurality of vertically spaced cylinder bores, a cylinder head affixed to one end of said cylinder block so as to close one end of said cylinder bores, a crankcase member is affixed to the other end of said cylinder block so as to close the other end of said cylinder bores and to form a crankcase chamber in which a crankshaft is rotatably journaled, pistons slidably supported in each of said cylinder bores and connected to said crankshafts to drive the crankshaft, said pistons, said cylinder bores and said cylinder head forming combustion chambers of said engine, and an induction system for delivering at least an air charge to said engine combustion chambers, said induction system includes a vertically extending, elongated plenum chamber that is juxtaposed to said crankcase member and which has an air inlet opening formed in a side thereof, a plurality of runner sections extending from said plenum chamber to individual intake ports of said engine, said runner sections all extending along one side of said engine, said induction system comprised of at least said plenum chamber, said runner sections and a manifold that attaches to said individual intake ports of said engine connected as a unit and attached to the remaining engine body with the use of locating pins fixed to the engine body, each locating pin having a first end, which is coupled into the engine body, and a second end which extends into the manifold, the second end of at least one of the locating pins being unthreaded.

11. An internal combustion engine as set forth in claim 10, wherein the induction system additionally includes a plurality of throttle bodies each containing a throttle valve, and each throttle body is associated with a respective one of the runner sections and forms a further part of the assembled unit.

12. An internal combustion engine as set forth in claim 11, wherein the throttle bodies are interposed between said runner sections and the intake manifold.

13. An internal combustion engine as set forth in claim 12, wherein the plenum chamber and the runner sections are formed from a synthetic resin.

14. An internal combustion engine as set forth in claim 10 in combination with an outboard motor, said outboard motor being comprised of a power head including a surrounding protective cowling enclosing the engine, the engine being mounted in said power head on an exhaust guide so that the crankshaft rotates about a vertically extending axis, the protective cowling including a tray portion having at least one generally upstanding wall lying next to a portion of the engine, and at least one of the locating pins lying next to the wall of the tray portion.

15. An outboard motor as set forth in claim 14, wherein the induction system further includes a plurality of throttle bodies each containing a throttle valve, and each throttle body is associated with a respective one of the runner sections and forms a further part of the assembled unit.

16. An outboard motor as set forth in claim 15, wherein the throttle bodies are interposed between said runner sections and the intake manifold.

17. An outboard motor as set forth in claim 16, wherein the plenum chamber and the runner sections are formed from a synthetic resin.

18. An outboard motor as set forth in claim 14, wherein said at least one locating pin, which is fixed to the engine body, is positioned lower than the upper edge of the tray.

19. An outboard motor comprising a power head including an engine and a surrounding protective cowling that has a tray portion, said engine being mounted in said power head on an exhaust guide so that the crankshaft rotates about a vertically extending axis, the protective cowling including a tray portion having at least one generally upstanding wall lying next to a portion of the engine, the internal combustion engine having a cylinder block with a plurality of vertically spaced cylinder bores, a cylinder head affixed to one end of said cylinder block so as to close one end of said cylinder bores, a crankcase member affixed to the other end of said cylinder block so as to close the other end of said cylinder bores and to form a crankcase chamber in which a crankshaft is rotatably journaled, pistons slidably supported in each of said cylinder bores and connected to said crankshaft to drive the crankshaft, said pistons, said cylinder bores and said cylinder head forming combustion chambers of said engine, and an induction system for delivering at least an air charge to said engine combustion chambers, said induction system includes a vertically extending, elongated plenum chamber that is juxtaposed to said crankcase member and which has an air inlet opening formed in a side thereof, a plurality of runner sections extending from said plenum chamber to individual intake ports of said engine, said runner sections all extending along one side of said engine, said induction system comprised of at least said plenum chamber, said runner sections and a manifold that attaches to said individual intake ports of said engine connected as a unit and attached to the remaining engine body, said induction system attached to said engine body by means for locating said induction system on said engine body without removing the tray portion.

20. An outboard motor as set forth in claim 19, wherein the induction system further includes a plurality of throttle bodies each containing a throttle valve, and each throttle body is associated with a respective one of the runner sections and forms a further part of the assembled unit.

21. An outboard motor as set forth in claim 20, wherein the throttle bodies are interposed between said runner sections and the intake manifold.

22. An outboard motor as set forth in claim 21, wherein the plenum chamber and the runner sections are formed from a synthetic resin.

23. An outboard motor as set forth in claim 19, wherein the means for locating is positioned lower than the upper edge of the tray.

* * * * *